US007454931B2

(12) United States Patent
Cordes

(10) Patent No.: US 7,454,931 B2
(45) Date of Patent: Nov. 25, 2008

(54) METHOD AND DEVICE FOR TREATING TEXTILE FABRICS IN ROPED FORM

(75) Inventor: Carl Cordes, deceased, late of Schwabish Hall (DE); by Lee Che Keung, legal representative, Hong Kong (CN)

(73) Assignee: Then Maschinen (B.V.I.) Limited, Tortola (VG)

( * ) Notice: Subject to any disclaimer, the term of this patent is extended or adjusted under 35 U.S.C. 154(b) by 580 days.

(21) Appl. No.: 10/967,319

(22) Filed: Oct. 19, 2004

(65) Prior Publication Data

US 2007/0283725 A1 Dec. 13, 2007

(30) Foreign Application Priority Data

Oct. 21, 2003 (DE) ..... 103 49 384

(51) Int. Cl.
*D06B 5/02* (2006.01)

(52) U.S. Cl. ..... 68/178; 68/179

(58) Field of Classification Search ..... 68/177, 68/178, 179

See application file for complete search history.

(56) References Cited

U.S. PATENT DOCUMENTS 1,781,391 A * 11/1930 Hinnekens ..... 68/176
3,659,438 A * 5/1972 Chiba et al. ..... 68/177
3,718,012 A * 2/1973 Vians ..... 68/9
4,036,038 A * 7/1977 Aurich et al. ..... 68/5 C
4,885,814 A * 12/1989 von der Eltz et al. ..... 8/149.1
5,014,525 A * 5/1991 Bene ..... 68/20
5,129,242 A * 7/1992 Sturkey et al. ..... 68/178
5,249,374 A * 10/1993 Henningsen et al. ..... 34/213
5,577,282 A * 11/1996 Turner et al. ..... 8/152
5,642,548 A * 7/1997 Osbourn ..... 8/152

FOREIGN PATENT DOCUMENTS

GB 2 246 372 * 1/1992
JP 60-194163 * 10/1985

* cited by examiner

*Primary Examiner*—Frankie L Stinson
(74) *Attorney, Agent, or Firm*—Kratz, Quintos & Hanson, LLP

(57) ABSTRACT

This is a device or equipment for treating the textile fabric shaped like a rope and it has a container and a transport nozzle system for the textile fabric. The transport nozzle systems have at least two separate transport nozzles arranged one beside the other axially, for each one of the respective rope-materials, whereby the transport nozzles are placed in a common transport-medium (medium of transport) distribution equipment. The transport-medium (medium of transport) distribution equipment is connected to a transport-medium (medium of transport) circulating equipment, and it contains the inlet for the transport-medium (medium of transport) of the transport-nozzles along with a space/room for impingement of the transport-medium i.e., medium of transport.

18 Claims, 3 Drawing Sheets

METHOD AND DEVICE FOR TREATING TEXTILE FABRICS IN ROPED FORM

Figure 1:
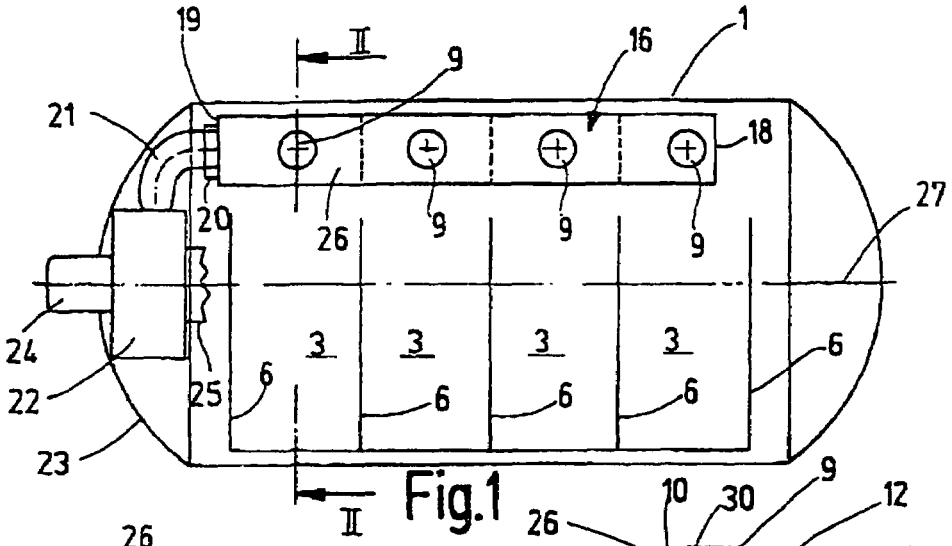

This invention deals with a device or equipment for the treatment of rope-shaped textile fabric, which are known in practice as so-called JET dyeing machines.

Such JET machines or units work with transport nozzle systems for the transport of textile fabric. In the case of JET machines which work on the so-called aerodynamic principle, as they are described on pp. 748-754 in Melliland—Textilberichte 69 (1988), on pp 31-35 in Textiltechnik 38(1988) and on pp 27 41 in the Internationales Textil-Bulletin-Veredelung 31 (1985) 3 a closed loop rope-material which is in a closed container, is set in circular motion by means of a transport nozzle system, which is often designed as a JET nozzle, on which (i.e., the jet nozzle) a stream of gas acting as a medium of transport impinges. This stream of gas imparts the forward feed motion to the rope-material in the desired direction of circulation. As it is known from the EP 0014919, heated gas or jet of steam is to be used as medium of transport of the rope-material. A pre-heated bath of dye material, which is heated outside the container, is pressed through (squeezed on) the JET nozzle, which acts on the through-running rope-material. There are also textile-processing machines that work on aerodynamic principle, and they are described in the EP 0665319 A3 and 0640710 A2. In this process, a closed loop type of fabric web is subjected to a mechanical or thermal treatment, during its movement within the transporting equipment, wherein the motion or movement is actuated by a gaseous medium of transport, flowing through a JET nozzle. This is done in order to modify the volume, the gripping/holding properties, the properties of the outer surface or the water content of the fabric-web loop in a desired manner.

It is known that in the case of these JET units more number of fabric-web loops or ropes are simultaneously processed and a corresponding number of axially arranged nozzles are provided for this purpose. And there are also storing equipment allotted to these nozzles for each one of the unwrapped rope-material. In the case of these multiple storage machines, each one of the transport nozzles is surrounded by a nozzle housing in that section where the slit type of gas inlet is located, which (i.e., the housing) is connected to a tube (pipe) through its own gas pipeline. And the tube (pipe) connected to the above housing is connected to a common blower/fan. As a rule, the blower/fan itself is located outside the container used for treatment, and on the suction side it is connected to the inside of the container.

The design of the transport nozzles with their own nozzle housings and their connection to source of the transport medium via their branching pipelines is expensive. Moreover the distribution of the medium of transport and the impingement of the transport nozzles is not at times uniform.

Therefore, the aim of this invention is to further develop the device mentioned in the beginning—meant for treating rope type textile fabric—so as to eliminate these disadvantages. The device or equipment discussed herein makes use of the features claimed in patent claim 1 for solving this problem.

In this newly developed device or equipment, the transport nozzle configuration has at least two separate transport nozzles, placed axially one beside the other for each one of the respective rope-materials. In such an arrangement, the transport nozzles are fixed into a common distribution equipment for the medium of transport, which is connected to the circulating equipment for the medium of transport. And the distribution equipment has room or chamber with inlet in the nozzles meant for the medium of transport, and the medium of transport impinges on this chamber or space. Thereby, the distribution equipment of the transport medium acts on the principle known as Common-Rail-Principle. Since the transport nozzles are directly fixed in this transport-medium distributor, special housing and branch lines are not necessary, for the nozzles themselves. At the same time, a uniform distribution of the medium of transport is guaranteed for the individual transport nozzles.

In a design or execution that is normally preferred, the distributor of the medium of transport has a transport-medium distributor box, in which the nozzles are placed, and it is connected to the suction side of the circulating equipment This distributor box stretches itself out, at least over one portion of the axial length of the container. However, in such a design, it can be placed either outside or inside the container. The advantage of such a distributor box is, that it provides a very uniform distribution of the gaseous medium of transport, because the speed of the medium of transport can be maintained at a low level, by virtue of the correspondingly bigger dimensioning of the cross-section of the box. If necessary, additional features can be incorporated, in order to improve the uniformity of distribution of the medium of transport, in the individual transport nozzles. Thus, e.g., guiding members for the medium of transport can be fixed in the distributor box, which—among other things—can be made of guiding (directing) sheet metal plates, which would surround or enclose the transport nozzles, at least partially. Such guide plates create a concentric flow of the gaseous medium of transport coming from the distributor box, and direct them into the transport-medium inlet of the transport nozzle, which is shaped like an annular gap. Seen from an overall point of view, this arrangement or layout of the nozzles directly in the transport-medium distributor box, guarantees an effective and efficient flow of the medium of transport into the transport nozzles, and thus a trouble-free transport of the rope-material.

The noise emission produced by the transport nozzles fixed in the distributor box, gets automatically reduced in the distributor box, placed in the container. Simultaneously, the outward heat radiation from the distributor box is largely eliminated, because of which the thermal efficiency of the entire machine is increased. Finally, the distributor box placed in the container along with its transport-nozzles, presents an advantage in that the respective rope-material will have to be raised only to lower height, when compared to the usual or traditional machines, whereby the materials are treated gently during transport, thus avoiding damage to them.

Independent of the fact, whether the distributor box is placed inside or outside the container, the regulating medium which can be actuated and which controls the impingement of the medium of transport on the nozzles, can be attached to it, i.e., the distributor box, as an optional feature. These regulating (control) mediums can have a single-unit type of regulating element that controls the feeding-in of the medium of transport. Or alternatively, the design can be such that the transport nozzles have regulating (control) elements that can be actuated optionally, so that the impingement of the medium of transport on the individual transport nozzles can be regulated i.e., controlled independently. Apart from the necessary guiding elements mentioned above—which may be needed under certain given conditions—no other complicated and expensive diversions or the like are otherwise necessary, so as to feed the medium of transport to the transport nozzle with a higher degree of efficiency. And owing to this higher efficiency, the power (i.e., capacity or energy consumption) of the equipment that brings the medium of transport into circulation can be proportionately reduced.

The object of the sub-claims further establish or illustrate the subject or the matter dealt with in the invention.

The examples of execution of the subject or item dealt with in this invention is illustrated in the drawing. They show the following:

FIG. 1—Shows the longitudinal cross-section in a schematic illustration of a device or equipment as per this invention, designed in the form of a JET piece dyeing machine, working on aerodynamic principle and having a distributor box placed in the container to facilitate the medium of transport.

Figure 2:
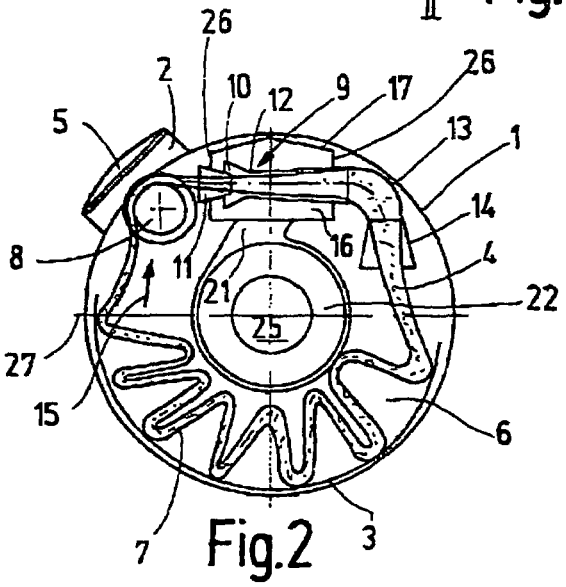

FIG. 2—Shows the same device or equipment of FIG. 1, however cut lengthwise along the line II-II of FIG. 1 showing the side view.

Figure 3:
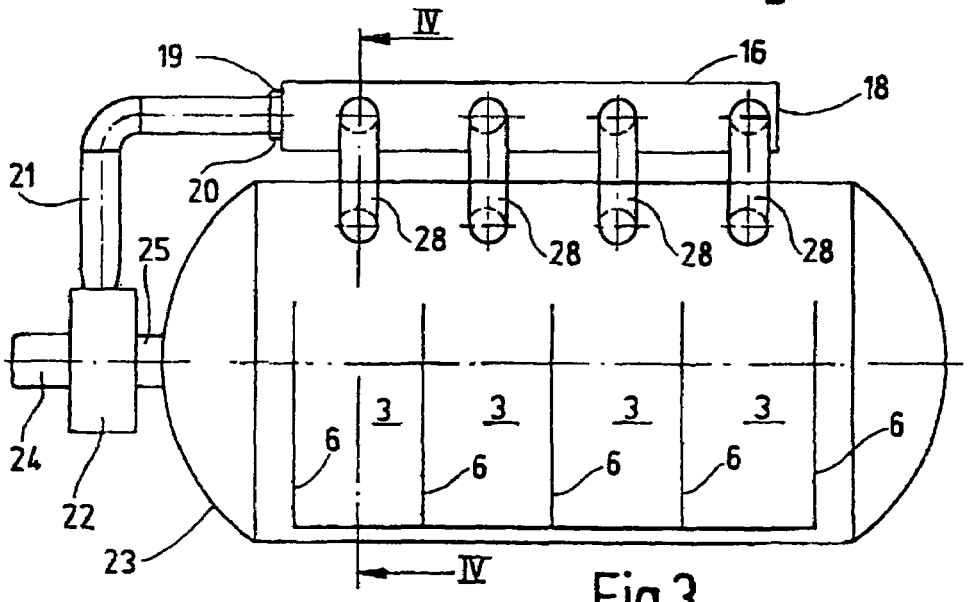

FIG. 3—Shows the device or equipment dealt with in this invention in the form of a JET piece dyeing machine, working on aerodynamic principle and a transport-medium distributor box placed outside the container—showing a sectional view in a schematic representation similar to FIG. 1.

Figure 4:
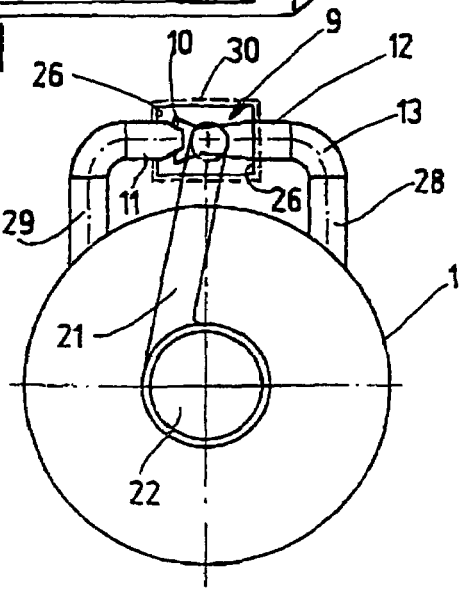

FIG. 4—Shows the device or equipment of FIG. 3 however, cut lengthwise along the line IV-IV of FIG. 3 showing a side view.

Figure 5:
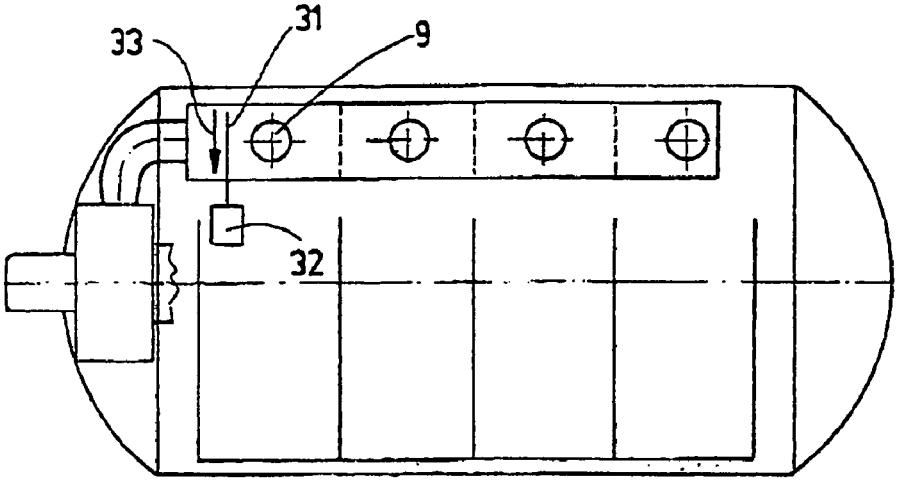

FIG. 5—Shows the device or equipment as per FIG. 1, however in a modified form of execution and view of section corresponding to FIG. 1.

Figure 6:
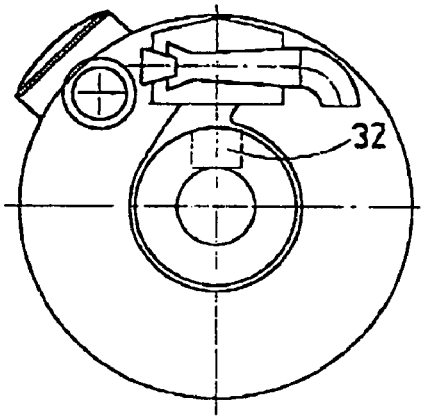

FIG. 6—Shows the device or equipment as per FIG. 5, but lengthwise along the line VI-VI of FIG. 5 showing a side view.

Figure 7:
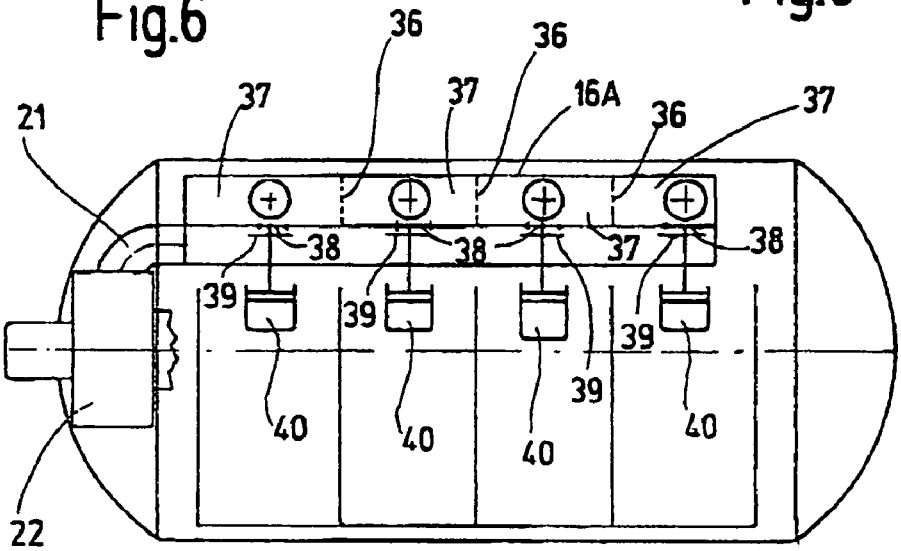

FIG. 7—Shows the device or equipment as per FIG. 5, however in a further modified form of execution in a sectional view corresponding to FIG. 1.

Figure 8:
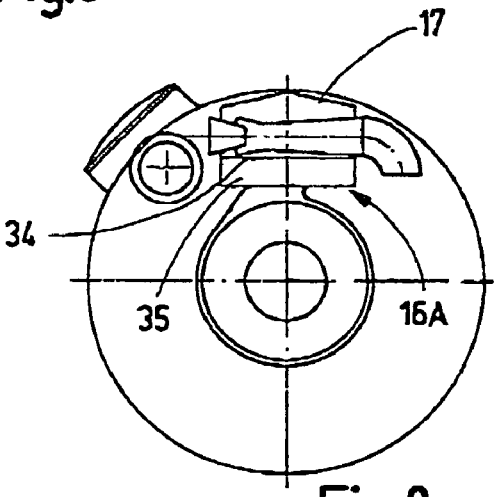

FIG. 8—Shows the equipment or device as per FIG. 7, lengthwise along the line VIII-VIII of FIG. 7 showing a side view.

Figure 9:
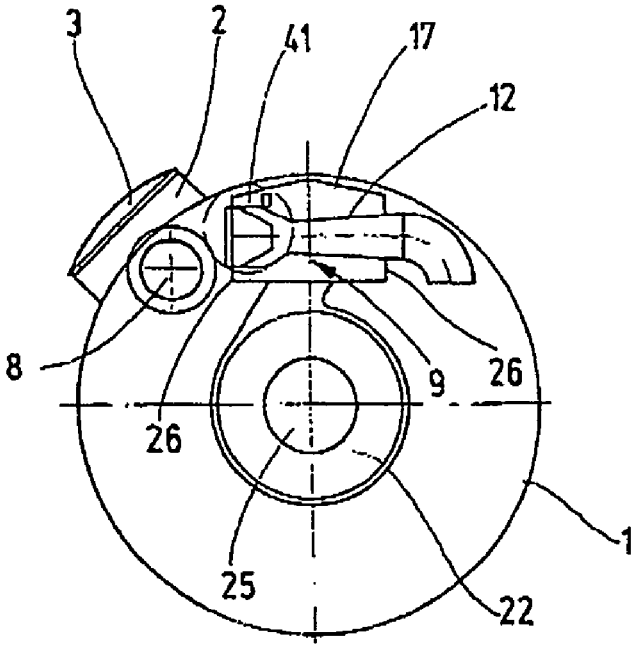

FIG. 9—Shows the device or equipment as per FIG. 2, however illustrating the control elements for regulating or controlling the impingement of medium of transport on the transport-nozzles, showing a sectional view corresponding to FIG. 2

Figure 10:
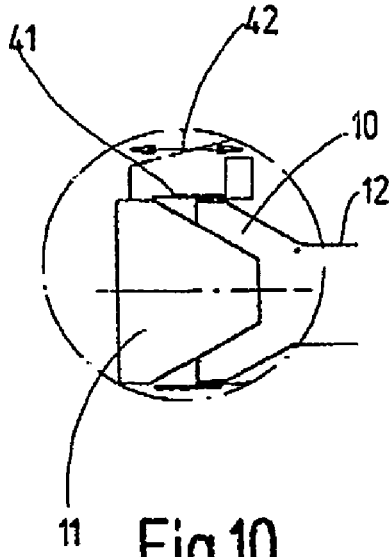

FIG. 10—Shows a section of the device or equipment as represented in FIG. 9 however to another scale.

The device or equipment shown in FIGS. 1 & 2 is a JET piece-dyeing machine having more number of storage facilities—here in this case four—and it works according to the principle of aerodynamics. The basic set-up or construction of such a JET-piece dyeing machine is well known (compare e.g., EP 0945538 B1) and hence, only those features that are relevant to the invention are discussed in the following paragraphs.

The device or equipment has a closed container 1 that is purely schematically shown in FIG. 1. Basically, the container is shaped or designed in the form of a cylindrical pressure vessel. There are four operating/working openings 2 that lead into the container 1—as could be seen from FIG. 2—of which each one is attached to one storage facility 3 for one closed loop of rope-material 4 and it can be closed/sealed by a pressure-tight operating/working opening 5. The storage facilities 3 are enclosed on the sides by partition walls 6 along the direction of the axis of the container 1. The rope-material 4 lying in them is unwrapped or unwound as illustrated in 7.

There is a spool 8 in container 1 which is mounted such that it can rotate. It is driven by a frequency-controlled/regulated electric motor that is not shown here. The transport nozzle elements fixed in container 1 are connected with the spool, and they i.e., the transport-nozzle elements have self-contained venturi-type transport nozzle for each storage facility 3. And this is shown purely schematically in FIG. 2. Each transport nozzle 9 has an annular gap 10 that serves as inlet for the gaseous transport medium, like e.g., air, gas, steam or a mix of air and steam. This annular gap is formed between the cone of the nozzle 11 and a diffuser 12 that is coaxially formed with respect to it. The diffuser 12 turns into a bow-shaped connection piece 13, to which the unwrapper (unwinder) 14 is connected.

In operation, the rope-shaped textile fabric is fed into the container 1 through the respective operating opening 2 (opening meant for use during operation or working) and placed on the spool 8 and fed through the transport nozzle 9. Thereupon, the ends of the rope-material are connected to one another to form a closed loop material. After the container 1 is loaded with the four rope-materials 4 allotted to the four respective storage facilities 4 the openings 2 are closed, and the gaseous medium of transport impinges on transport nozzles 9 whereby each loop type rope-material 4 is set in circular motion in the clockwise direction—with respect to the FIG. 9—and this is indicated by arrow 15. The rope-material 4 is treated during this circular motion by the treatment-bath stored in the container. This bath is brought into circulation and fed on to the respective rope-material 4, in the rope-material section 9. The pipelines, pumps and the like needed for this purpose, are not shown in detail. For such details, please refer to the EP 0 945 538 B1 or EP 0 078 0722 A1 mentioned already.

There is a transport-medium distributor box 16 in the container, which is placed above the storage facility 3. The box 16 juts out beyond the storage facility 3, predominantly in the direction of the axis, and it has a ceiling-like top cover 17, with rectangular form of cross-section, which is matched with the elbow(bend) of the casing(shell) of the container. This is illustrated in FIG. 2. This form of design of the distributor box 16 makes it compact, so much so that it occupies less space in container 1. One side 18 of the distributor box 16 is sealed, and on the opposite side 19 it is connected to a high-pressure duct 21 of a fan/blower 22 through a screw coupling 20, which forms a part of the circulating equipment of the medium of transport.

As it can be seen from FIG. 1 the blower 22 is placed in the container 1, in its area of the adjacent torospherical head or base 23. It is driven by an electric motor 24, which projects from the container 1 on the side. And it is located in a housing that is tightly sealed from the inside of the container. The fan/blower has a suction pipe/tube 25, which spans over the axial length of the storage facility 3, and which is coaxially perforated towards the container 1. This pipe/tube facilitates the suction of the air-steam mix from inside the container and convey or transport it to transport medium distributor box 16, via the high pressure duct 21.

As it can be specifically seen in FIG. 2, the transport nozzles 9 are inserted directly into the transport-medium distributor-box 16, in a such a manner that they are placed axially in parallel position with respect to one another and cross through the side walls 26 of the distributor box that are opposite to one another. Therein the jet cone 11 is tightly connected on one side and diffuser 12 on the other, and projects over the side wall of the respective distributor box 16. Therefore, the transport nozzles 9 are located in the distributor box 16 with their annular gaps 10 that form the inlet of the transport-medium. And in this respect the distributor box 16 covers or encloses all the transport nozzles.

While in operation, the gaseous transport medium that is blown by the fan/blower 22 impinges on the inner space of the distributor box 16. The gaseous transport medium concentrically flows into the transport nozzle 9 via the annular gap 10, thus creating a transport of the rope-material 4 in a manner that will not cause any damage to the material (in other words protect it.) As the distributor box 16 has a relatively higher cross-section—as can be seen in FIG. 2—the speed/velocity of the medium of transport is comparatively lower in the distribution box 16, and as a consequence of this, the distribution of the medium of transport on the four transport nozzles 9 is very uniform.

As a consequence of placing the transport-medium distributor box 16 in the container 16, the distributor box 16 hardly radiates any heat outside the container, so much so that hardly any thermal loss of the transport medium occurs, while it (transport medium)is hot and traverses through the distributor box 16 and the transport nozzles 9. That apart, the distributor box 16 reduces the noise generated by the transport nozzles 9. As far as the wall thickness of the walls 17,18,19,& 26 is concerned, it has to be designed in such a manner that it will be sufficient if it withstands the max. rise in pressure created by the fan/blower 22, and need not be designed for max. operating pressure of the container 1. This is so because the distributor box 16 is placed in the container 1. Finally, FIG. 2 shows that, because of the layout of the distributor box 16 along with the transport nozzles 9 fixed into them, the transport nozzles 9 in the upper section of the container 1—which while in operation lies in the horizontal axis—come closer towards a spot that is relatively nearer the middle axis 27 of the container 1. As a result of this, the outlet of the rope-material 4 from the storage facility 3 is at a lower height, whereby the protection to the material during transport, i.e., movement or motion, is also taken care of.

The only difference between the execution or design shown in FIGS. 3&4 and that of FIGS. 1&2 is that, the distributor box 16 of the transport-medium is placed outside the container 1. Therefore, in FIGS. 1 & 2 same reference marking is given for identical parts, and the annotation/explanation is also dispensed with. For the sake of simplicity, even the rope-material 4 is not shown in FIG. 4. In the distributor box 16 which is rectangular in cross-section, which is placed directly on this parallel in the axial plane with respect to the cylindrical container 1, four transport nozzles 9 are directly mounted—as shown in FIG. 2—such that the inlet of transport-medium that forms the annular gap 10 is surrounded by the distributor box 16. In the case of each one of the transport nozzles 9, the bend of the tube/pipe 13 found at the outlet of the diffuser, is taken back to the container 1 via a vertical piece of pipe/tube 28 found in that section of the respective storage facility 3, whereas the cone of the nozzle 11 is connected to the container 1 through a pipeline 29 above the spool 8 of FIG. 4, which, however is not shown.

In this type of execution, the fan/blower 22 is fixed outside the container 1, which is coaxial with respect to this (container). Its high pressure duct 21 is again connected the face side 19 of the distributor box 16, through a screw coupling 20 and a corresponding piece of pipe/tube If necessary, the distributor box 16 can be fitted with a sheath or a casing, which would especially act as sound-absorbing or heat-insulating medium. This shown in dotted lines at 30 in FIG. 4. In the case of the executions described herein, the transport-medium distributor box 16 is represented as a tube/pipe, which primarily juts out beyond the length of the container 1, and has rectangular cross-section, which again is bounded by at least two parallel side-walls 26 on two sides. Basically, the distributor box 16 can naturally have any appropriate form of cross-section, especially, also such a form/shape that matches with the inner contour or that which fits well with the internal components it may contain. Especially with devices or equipment that have multiple storage facility, it maybe appropriate to provide additional features/measures along its axial length, so that uniform impingement of the medium of transport on the individual transport nozzles will be assured, irrespective of their distance from the mouth or port of the high-pressure duct 21 of the fan/blower. For this purpose, e.g., air-distributing parts in the form of air-guiding sheet metal plates and baffle plate or the like can be provided in the distributor box 26. If necessary, it would be proper to provide ring-shaped metal guide plates around the transport nozzles 9, which would take care of entry of the transport-medium from the distributor box into the annular gap 10 of the respective transport nozzle. Yet another method by which uniform impingement of the transport-medium on the transport nozzle can be achieved, is to change the cross-section of the distributor box 16 along its axial-length. And this is to be done in such a manner that a uniform speed of flow is assured all over the distributor box 16.

The distributor box 16 that is based on the Common-Rail-Principle, also enables one to regulate the impingement of the transport-medium on transport-nozzles 9 in a simple manner, as per requirement. In the case of one of the executions of FIGS. 5 & 6 a regulating component in the form of a pusher 31 can be incorporated and it can be regulated/controlled by means of a regulating device 32. And this device can be taken back to an inactive position in the direction of the arrow 33, from the blocking position as shown in FIG. 5. The pusher 31 is positioned between the face wall 19 of the distributor box 16 that is connected to the high-pressure duct 21 of the fan/blower 22, and the first transport nozzle 9 that is adjacent to this. And thus it can take care of overall regulation of the flow of transport-medium to the distribution box 16. In this manner, the impingement of the transport-medium of the four transport nozzles 9, uniform regulation is achieved for all the transport nozzles.

Additionally or alternatively, the regulating component or part attached to the distributor box 16 can also be so designed that it is possible to realize individual regulation of the impingement of the transport medium, individually for every transport nozzles 9. FIGS. 7 & 8 illustrate such a form of execution. The transport-medium distributor box 16*a*, housed in the container 1, is basically constructed in a manner similar to the distributor box 16 shown in FIGS. 1 & 2.

However—as it is to be especially seen in FIG. 8—it has a partition wall 34 which is parallel to the base wall and is at a distance from it, and which forms a boundary limit to the space of the distribution box 35, into which the high-pressure duct 21 of the fan/blower 22 placed in container 1 runs or joins.

The partition wall 34 runs below the transport nozzles 9, whereby the space above the partition wall 34 and below the ceiling wall 17 is sub-divided through diagonal walls 36 in the distributor box 16*a* which again form the boundaries for the spaces where the medium of transport is fed, and where there is room for one transport nozzle 9 in the respective space among them. These spaces 37 through which the transport medium is fed, are connected to the distributor box room 35 via through-running openings 38, whose cross-section of entry of the transport-medium can be regulated by means of blocking component 39, which in turn and can be individually adjusted by a setting or adjusting device 40 attached to the respective blocking component 39.

While the individual regulation or control of the impingement of transport-medium of the individual transport nozzles 9 are achieved by features incorporated in the distributor box 16*a*, in the case of executions shown in FIGS. 7 & 8, it is also possible to have such forms of execution in which it is achieved by modifications to the transport nozzles 9 themselves. Such a form of execution i.e., such a type is shown in FIGS. 9 & 10. In this form of execution i.e., type, a sliding sleeve 41 is placed on the cone of the nozzle 11 which limits the annular gap 10 and/or on the extended part of the diffuser 12 that forms the collecting nozzle 12, which—as it can be seen in FIG. 10—can be moved to and from in the direction shown by the dual arrow, in such a manner that it more or less covers the annular gap. The flow or stream of transport-medium into the respective transport nozzle can thus be individually adjusted, as this is necessary for a safe transport at max. speed. Because of the possibility or facility of closing the annular gap 10 totally, the necessity of having to have a shut-off flap valve is dispensed with, which would otherwise be necessary, if a transport nozzle is not made use of. As the shut off type flap valve is not made use of, the flow resistance that would have been otherwise contributed by it, is not be found, thus increasing the efficiency of the whole equipment or device.

In FIGS. 5 to 10 same reference marks are used for identical parts as in FIGS. 1 & 2 because of which these parts are dispensed with, when a repeated explanation are annotation is given.

In the preceding paragraphs the invention is described in the light of a JET treatment machine that works on aerodynamic principle. But, it is also basically possible to make use of the common-rail-concept of the JET transport-medium distribution box 16 and 16*a*, along with the transport nozzles 9*a* directly mounted on them, in JET treatment machines, that work with a liquid transport-medium and hence operated on hydraulic principle.

The container 1 is designed as a pressure-tight vessel (pressure vessel) in the type of execution dealt with herein. However, the equipment of this invention can also be used with atmospheric machines, in which the container is not pressure-tight.

The invention claimed is:

1. A device for treating textile fabric that is in the form of rope comprising:

a container (1), transport nozzle devices for the textile fabric, a transport-medium circulating equipment (21,22 & 25) connected to the transport nozzle devices on the high-pressure side, which transport nozzle devices are directly fixed in a transport-medium box extending over a portion of an axial length of the container, and to the container on the suction side, and storage equipment (3) built into the container for holding the rope (4), wherein the transport nozzle devices have two separate transport nozzles (9) placed axially one beside the other, for rope (4) and the transport nozzles are placed in a common transport-medium distribution equipment (16 & 16*a*) that is connected with the circulating equipment which has space between a cone of the transport nozzle and a diffuser, with inlet of the transport medium (10) for transport nozzles, where the transport medium impinges.

2. The device as per claim 1 is characterized by the fact that, the medium of transport is gaseous.

3. The device as per claim 1 is characterized by the fact that, the medium of transport is a fluid.

4. The device as per claim 3 is characterized by the fact that, the circulating systems of the transport medium have at least one fan/blower (22) which is fixed in the container (1).

5. The device as per claim 4 is characterized by the fact that, the fan/blower is fixed in the section or area of the side wall (23) of the container (1).

6. The device as per claim 4 is characterized by the fact that the fan/blower (22)is driven by an electric motor (24) and the driving motor at least partially located outside the container (1).

7. A device for treating textile fabric that is in the form of rope comprising:

a container (1) that is a cylindrical vessel having a horizontal axis;

transport nozzle devices for the textile fabric, a transport-medium circulating equipment (21,22 & 25) connected to the transport nozzle devices on the high-pressure side and to the container on the suction side, a plurality of storage facilities (3) built into the container for holding the rope (4), the storage facilities separated by partition walls and disposed along the horizontal axis of the cylindrical vessel, wherein the transport nozzle devices are a plurality of nozzles (9) placed axially one beside the other, for the rope (4) with a transport nozzle provided at each of the storage facilities, and the transport nozzles are placed in a common transport-medium distribution equipment (16 & 16*a*) that is connected with the circulating equipment which has space, with inlet of the transport medium (10) for transport nozzles, where the transport medium impinges, and the transport-medium distribution equipment has a transport-medium distributor box (16 & 16*a*), extending parallel to the horizontal axis, which is connected to the high-pressure side of the circulating equipment (21,22 & 25) and in which the transport nozzles (9) are located.

8. The device as per claim 7 is characterized by the fact that, the distributor box (16) is placed within the container (1).

9. The device as per claim 7 is characterized by the fact that, the distributor box (16) is placed outside the container (1).

10. The device as per claim 9 is characterized by the fact that the transport nozzles (9) are connected to the container (1) via the respective lines (28 & 29) on their inlet side and outlet side of the rope.

11. The device as per claim 7 is characterized by the fact that, the distributor box (16 & 16*a*) is designed in such a manner that it surrounds the transport nozzles at least in that section, where the inlet for the transport-medium (10) is located.

12. The device as per claim 7 is characterized by the fact that, optionally regulating devices or systems (39:41) that can be actuated are attached to the transport nozzles, through which the impingement of the medium of transport on the individual nozzles can be regulated.

13. The device as per claim 7 is characterized by the fact that, there are guiding or directing devices in the distributor box (16 &16*a*).

14. The device as per claim 13 is characterized by the fact that, the guiding devices for the medium of transport have guide-plates which at least partly enclose or surround the transport nozzles (9).

15. A device for treating textile fabric that is in the form of rope comprising:

a container (1) that is a cylindrical vessel having a horizontal axis, transport nozzle devices for the textile fabric, a transport-medium circulating equipment (21,22 & 25) connected to the transport nozzle devices on the high-pressure side and to the container on the suction side, a plurality of storage facilities (3) built into the container for holding the rope (4), the storage facilities separated by partition walls and disposed along the horizontal axis of the cylindrical vessel, wherein the transport nozzle devices are a plurality of transport nozzles (9) placed axially one beside the other, with a transport nozzle provided at each of the storage facilities for rope (4) and the transport nozzles are placed in a common transport-medium distribution equipment (16 & 16*a*) that is connected with the circulating equipment which has space, with inlet of the transport medium (10) for transport nozzles, where the transport medium impinges, and a transport-medium distribution box extending parallel to the horizontal axis has a regulating device or system (31; 39,41)—which is an alternative feature—for the impingement of the medium of transport on the transport nozzles (9).

16. The device as per claim 15 is characterized by the fact that, the regulating systems have the regulating devices (31, 32) controlling feeding-in of the medium of transport to the distribution box (16 & 16*a*).

17. A device for treating textile fabric that is in the form of rope comprising:

a container (1), transport nozzle devices for the textile fabric, a transport-medium circulating equipment (21,22 & 25) connected to the transport nozzle devices on the high-pressure side, and to the container on the suction side, storage equipment (3) built into the container for holding the rope (4), wherein the transport nozzle devices have two separate transport nozzles (9) placed axially one beside the other, for the rope (4) and the transport nozzles are placed in a common transport-medium distribution equipment (16 & 16*a*) that is connected with the circulating equipment which has space between a cone of the transport nozzle and a diffuser, with inlet of the transport medium (10) for transport nozzles, where the transport medium impinges, and the transport-medium distribution equipment has a transport-medium distributor box (16 & 16*a*) which is connected to the high-pressure side of the circulating equipment (21,22 & 25) and in which the transport nozzles (9) are located;

characterized by the fact that, optionally regulating devices or systems (39:41) that can be actuated are attached to the transport nozzles, through which the impingement of the medium of transport on the individual nozzles can be regulated; and the regulating systems have blocking components (31), through which the feeding spaces or areas of the medium of transport (37) that are attached to (or assigned for) the individual transport nozzles (9) and which are also connected with the inside of the distributor box (16*a*), can be partially or fully blocked from the distributor box.

18. The device as per claim 17 is characterized by the fact that, the feeding spaces for the medium of transport (37) of the individual transport nozzles (9) are separated from one another in the distributor box (16*a*) and they respectively have an opening for the feeding of the medium of transport (38) which (opening) runs into (or joins with) the inside of the distributor box, whose (the opening's) throughput cross-section can be controlled by the blocking device (31).

* * * * *